US011342150B2

(12) United States Patent
Lin et al.

(10) Patent No.: US 11,342,150 B2
(45) Date of Patent: May 24, 2022

(54) HIGH-INSULATION SMALL-SIZED HINGED ELECTROMAGNETIC RELAY

(71) Applicant: Xiamen Hongfa Signal Electronics Co., Ltd., Fujian (CN)

(72) Inventors: Jiabin Lin, Xiamen (CN); Weifeng Wang, Xiamen (CN); Xinshang Dong, Xiamen (CN)

(73) Assignee: Xiamen Hongfa Signal Electronics Co., Ltd., Xiamen (CN)

( * ) Notice: Subject to any disclaimer, the term of this patent is extended or adjusted under 35 U.S.C. 154(b) by 92 days.

(21) Appl. No.: 16/742,252

(22) Filed: Jan. 14, 2020

(65) Prior Publication Data

US 2020/0234903 A1 Jul. 23, 2020

(30) Foreign Application Priority Data

Jan. 18, 2019 (CN) ..... 201910103722.2

(51) Int. Cl.
*H01H 50/36* (2006.01)
*H01H 50/44* (2006.01)

(52) U.S. Cl.
CPC ..... *H01H 50/36* (2013.01); *H01H 50/443* (2013.01); *H01H 2050/367* (2013.01); *H01H 2050/446* (2013.01)

(58) Field of Classification Search
CPC ..... H01H 50/36
USPC ..... 335/78, 281
See application file for complete search history.

(56) References Cited

U.S. PATENT DOCUMENTS 4,537,520 A * 8/1985 Ochiai ..... B41J 2/28 101/93.05
6,225,880 B1 * 5/2001 Kern ..... H01H 49/00 335/78
6,266,867 B1 * 7/2001 Kern ..... H01H 49/00 29/602.1

(Continued)

FOREIGN PATENT DOCUMENTS

JP S54-147645 U 10/1979
JP H02-044239 U 3/1990
JP H03-032345 U 3/1991

OTHER PUBLICATIONS

Japanese office action dated Feb. 9, 2021 in connection with Japanese Application No. 2020-005538.

(Continued)

*Primary Examiner* — Alexander Talpalatski
(74) *Attorney, Agent, or Firm* — Wolf, Greenfield & Sacks, P.C.

(57) ABSTRACT

A high-insulation small-sized hinged electromagnetic relay, includes a bobbin, coil terminals, an iron core and a fixed contact block. The bobbin has a cylindrical portion for winding a coil, and the iron core includes a mandrel and a magnetic pole portion arranged on the upper end of the mandrel; the mandrel of the iron core is fitted into the central hole of the cylindrical portion of the bobbin, the coil terminals is assembled on the lower flange of the bobbin and positioned on one side in the width direction of the bobbin, and the fixed contact block is interposed in the upper flange and the lower flange of the bobbin and positioned on the other side in the width direction of the bobbin; the cylindrical portion is offset.

10 Claims, 13 Drawing Sheets

(56) References Cited

U.S. PATENT DOCUMENTS

| | | | | |
|---|---|---|---|---|
| 7,679,476 | B2 * | 3/2010 | Kubono ..... | H01H 51/2227 335/78 |
| 2001/0028291 | A1 | 10/2001 | Nobutoki et al. | |
| 2002/0135446 | A1 | 9/2002 | Takano et al. | |

OTHER PUBLICATIONS

Indian Examination Report for Indian Application No. 202024002262 dated Oct. 26, 2021.

* cited by examiner

HIGH-INSULATION SMALL-SIZED HINGED ELECTROMAGNETIC RELAY

RELATED APPLICATIONS

This application is based upon and claims Foreign priority benefits under 35 U.S.C. § 119(a)-(d) or 35 U.S.C. § 365(b) of Chinese application number 201910103722.2, filed Jan. 18, 2019, the entire contents thereof are incorporated herein by reference.

TECHNICAL FIELD

This disclosure relates to a technical field of relays, in particular to a high-insulation small-sized hinged electromagnetic relay.

BACKGROUND

A hinged magnetic circuit structure is a typical structure widely used in the relay industry. Because of its simple structure and relatively low manufacturing difficulty, this structure is suitable for the relays of different sizes and loads. However, the relay of this type, due to its structural limitations, also has disadvantage of poor insulation performance, especially on small-sized products, which is more noticeable due to the size and space limitations.

SUMMARY

A high-insulation small-sized hinged electromagnetic relay includes a bobbin, coil terminals, an iron core and a fixed contact block; the bobbin has an upper flange, a lower flange, and a cylindrical portion connected between the upper flange and the lower flange and used for winding a coil, and an axis of the cylindrical portion is vertically arranged; the iron core includes a mandrel and a magnetic pole portion arranged on an upper end of the mandrel; the mandrel of the iron core is fitted into a central hole of the cylindrical portion of the bobbin, the magnetic pole portion of the iron core is positioned on the upper flange of the bobbin and positioned in the middle position in the width direction of the bobbin; the coil terminals is assembled on the lower flange of the bobbin and positioned on one side in the width direction of the bobbin, and a part of the coil terminals is positioned in the winding window of the bobbin; and the fixed contact block is interposed in the upper flange and the lower flange of the bobbin and positioned on the other side of the bobbin in the width direction; the axis of the cylindrical portion deviates to a direction away from the fixed contact block with respect to the central line of the width of the bobbin by a preset distance, so that an axial symmetric center of the mandrel of the iron core is offset from the axial symmetric center of the magnetic pole portion of the iron core by the preset distance, to increase the distance between the coil and the fixed contact terminal, increase a creepage distance between the coil and the fixed contact terminal, and improve insulation capability.

In one embodiment of the present disclosure, the high-insulation small-sized hinged electromagnetic relay further includes a movable spring armature block and a yoke, wherein the yoke has one side fixed to a bottom end of the mandrel, and the other side positioned at the winding window of the bobbin; and the movable spring armature block has one side fixed to the other side of the yoke, and the other side positioned above the magnetic pole portion of the iron core at the upper flange of the bobbin; a central line of the other side of the movable spring armature block corresponding to the width direction of the bobbin is substantially collinear with a central line of the magnetic pole portion of the iron core corresponding to the width direction of the bobbin.

In one embodiment of the present disclosure, a first through hole for positioning and assembling the bottom end of the mandrel of the iron core is provided on one side of the yoke, and there is a preset distance between the central line on one side of the yoke corresponding to the width of the bobbin and the central line of the first through hole on one side of the yoke corresponding to the width direction of the bobbin.

In one embodiment of the present disclosure, the magnetic pole portion of the iron core is circular, oval or rectangular.

In one embodiment of the present disclosure, the fixed contact block includes an upper fixed contact terminal and a lower fixed contact terminal, and the upper fixed contact terminal and the lower fixed contact terminal are L-shaped respectively; the vertical sheet bodies of the upper fixed contact terminal and the lower fixed contact terminal are respectively interposed in the upper flange and the lower flange of the bobbin, and are positioned on the other side of the coil terminals in the width direction of the bobbin; the portions of the vertical sheet bodies of the upper fixed contact terminal and the lower fixed contact terminal positioned in the winding window of the bobbin are vertical structures and are arranged in parallel along the length direction of the bobbin.

In one embodiment of the present disclosure, a thickness direction of the vertical sheet bodies of the upper fixed contact terminal and the lower fixed contact terminal is consistent with a width direction of the bobbin; the portions of the vertical sheet bodies of the upper fixed contact terminal and the lower fixed contact terminal positioned in the winding window of the bobbin are coplanar on the other side of the width of the bobbin.

In one embodiment of the present disclosure, the upper flange and the lower flange of the bobbin are respectively provided with second through holes and third through holes, which are annularly closed and through which the vertical sheet bodies of the upper fixed contact terminal and the lower fixed contact terminal are inserted, so that the upper fixed contact terminal and the lower fixed contact terminal may only be assembled into the bobbin from up to down.

In one embodiment of the present disclosure, a width of the second through hole is larger than a width of the third through hole, one surface in the thickness direction of the lower portions of the vertical sheet bodies of the upper fixed contact terminal and the lower fixed contact terminal is provided with a clamping protrusion fixed with the corresponding third through hole; the upper fixed contact terminal and the lower fixed contact terminal are fixed on the bobbin by matching the clamping protrusion of the lower portion of the vertical sheet body with the corresponding third through hole of the lower flange of the bobbin, and the horizontal sheet bodies of the upper fixed contact terminal and the lower fixed contact terminal are completely exposed on the upper flange of the bobbin; one surface in the thickness direction of the upper portions of the vertical sheet bodies of the upper fixed contact terminal and the lower fixed contact terminal is provided with a positioning protrusion matched with the corresponding second through hole, and the upper fixed contact terminal and the lower fixed contact terminal are adjusted in positions on the bobbin by matching the positioning protrusion of the upper portion of the vertical sheet body with the corresponding second through hole of the upper flange of the bobbin.

In one embodiment of the present disclosure, a cut-off cross section of fixed contact terminal materials is further provided beside the position integrally connected with the horizontal sheet body, in top ends of the vertical sheet bodies of the upper fixed contact terminal and the lower fixed contact terminal, to provide a press-in position for a preset corresponding tool; the upper fixed contact terminal or the lower fixed contact terminal is pressed into the bobbin, and the press-in position and the clamping protrusion of the vertical sheet body are approximately collinear in the height direction corresponding to the bobbin.

In one embodiment of the present disclosure, a sinking platform lower than the winding window is further provided at an insertion position of the upper fixed contact terminal and the lower fixed contact terminal corresponding to one side of the winding window of the bobbin, in the lower flange of the bobbin, to further increase the creepage distance between the position and the coil; an inclined chamfer is arranged between the sinking platform and the winding window, and an edge of the chamfer is flush with the third through hole; a first groove is arranged near the vertical sheet body of the upper fixed contact terminal, between the horizontal sheet body of the lower fixed contact terminal and the vertical sheet body of the upper fixed contact terminal, in the upper flange of the bobbin; the first groove is arranged along the length direction of the bobbin, and a length dimension of the first groove is larger than a width dimension of the vertical sheet body of the upper fixed contact terminal; a second groove is also arranged between the coil terminals and the insertion positions of the upper fixed contact terminal and the lower fixed contact terminal, in one surface corresponding to the winding window of the bobbin, in the lower flange of the bobbin.

In one embodiment of the present disclosure, a retaining wall is further arranged between the two second through holes on the upper flange in the upper flange, in the upper flange of the bobbin, to increase the insulation distance between the upper fixed contact terminal and the lower fixed contact terminal.

The present disclosure will be described in further detail below with reference to the drawings and embodiments. However, the high insulation small-sized hinged electromagnetic relay of the present disclosure is not limited to the embodiments.

DETAILED DESCRIPTION

Figure 1:
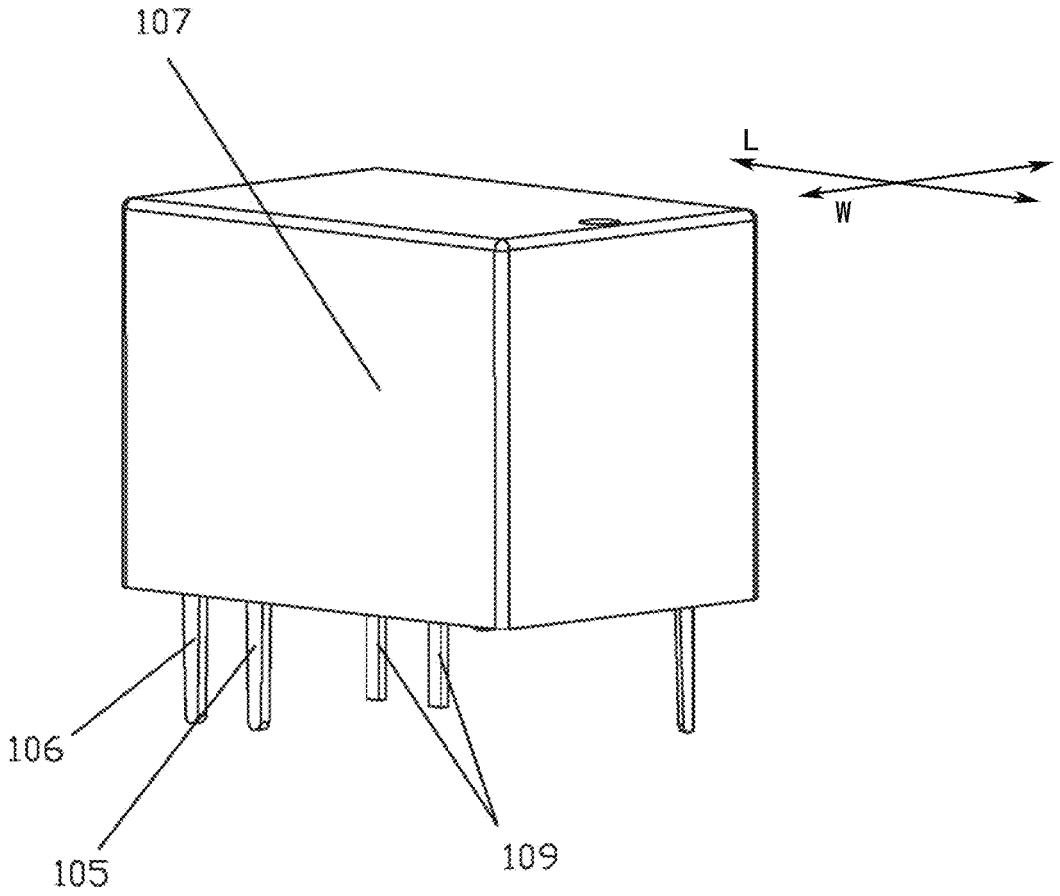
FIG. 1 is a schematic appearance of a hinged electromagnetic relay in the related art.
Figure 2:
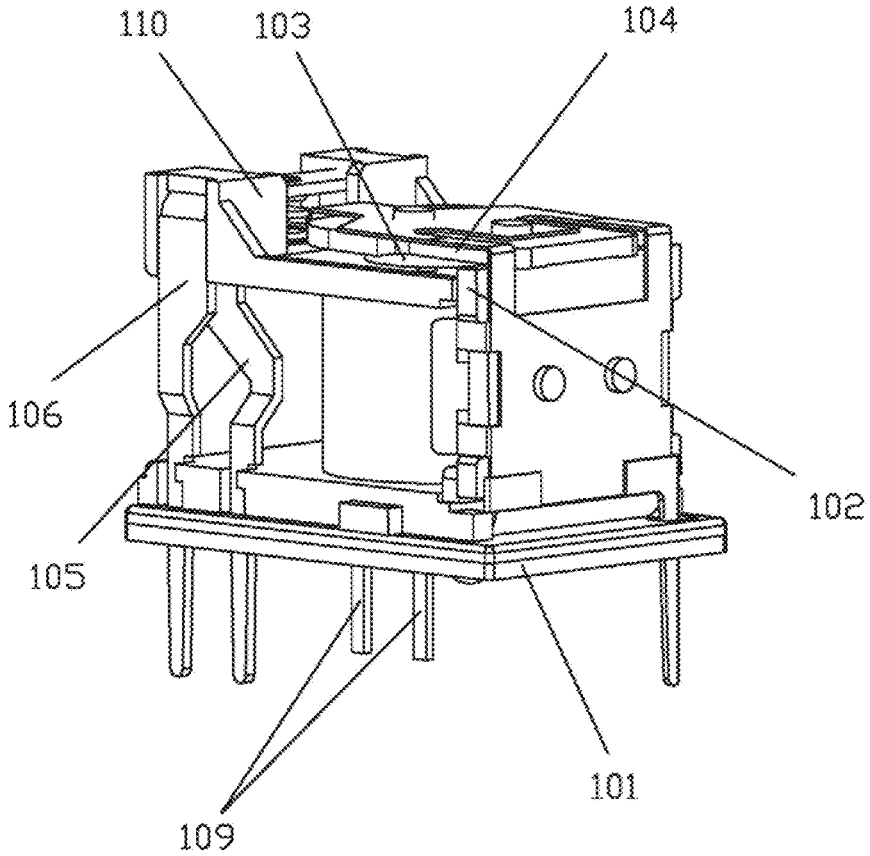
FIG. 2 is a schematic perspective view of the hinged electromagnetic relay (removing a housing) in the related art.
Figure 3:
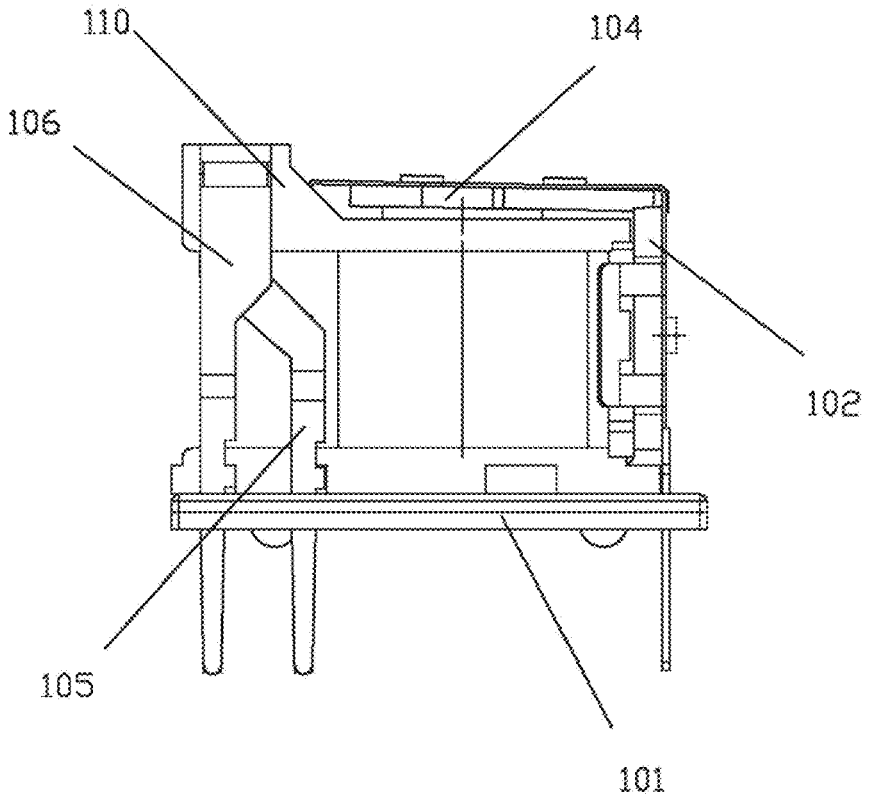
FIG. 3 is a front view of the hinged electromagnetic relay (removing the housing) in the related art.
Figure 4:
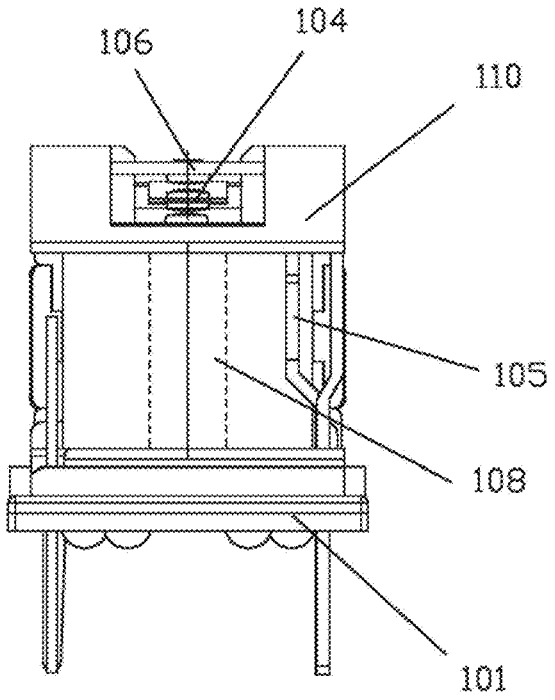
FIG. 4 is a side view of the hinged electromagnetic relay (removing the housing) in the related art.
Figure 5:
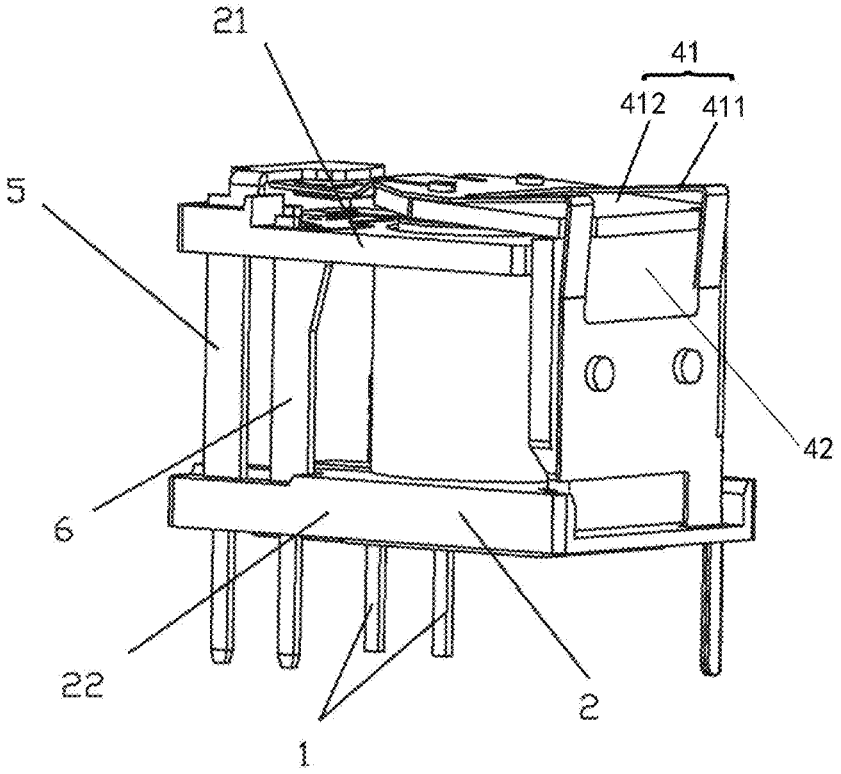
FIG. 5 is a schematic perspective view of an embodiment of the present disclosure (removing the housing)
Figure 6:
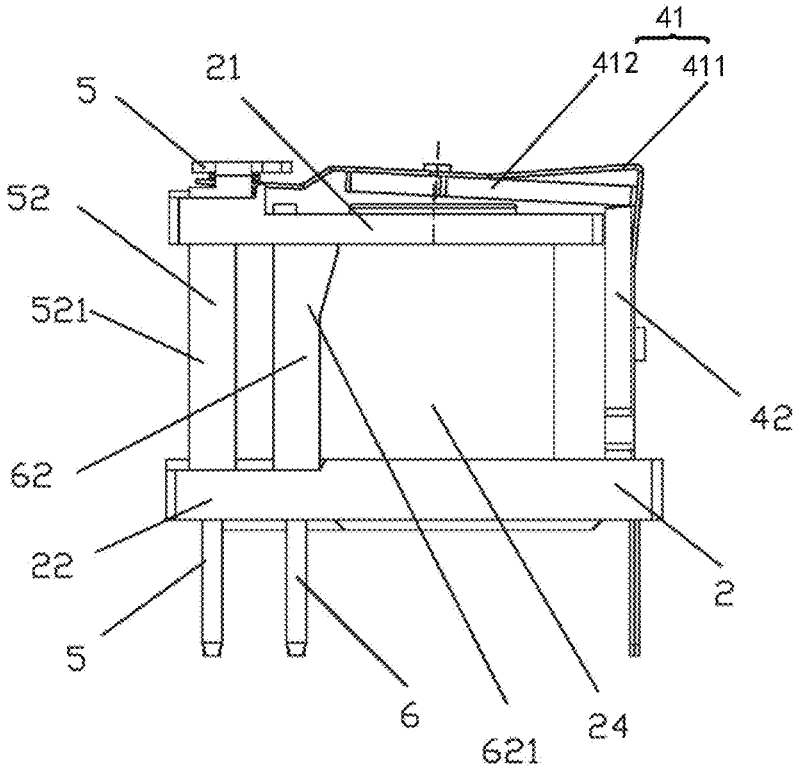
FIG. 6 is a front view of the embodiment of the present disclosure (removing the housing)
Figure 7:
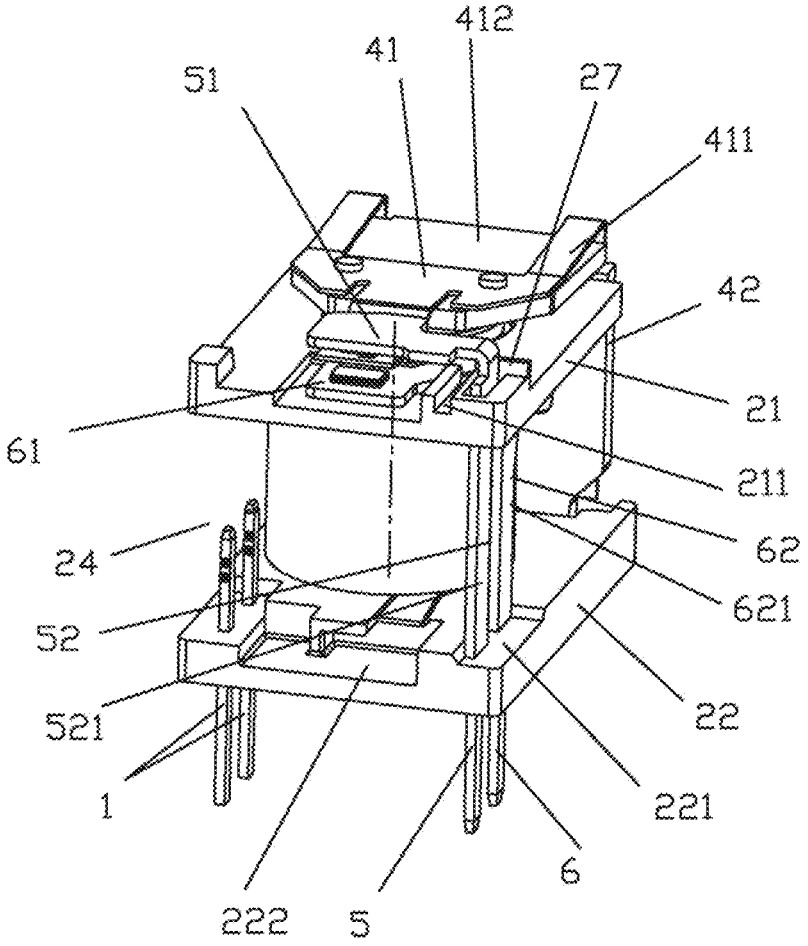
FIG. 7 is a schematic perspective view (rotated by an angle) of the embodiment of the present disclosure (removing the housing)

A small-sized hinged electromagnetic relay in the related art is shown in FIGS. 1 to 4. The relay includes a bobbin 101, a yoke 102, an iron core 103, a movable spring armature assembly 104, a normally opened fixed contact terminal 105, a normally closed fixed contact terminal 106, and a housing 107. The bobbin 101, as a main body of the relay, has a cylindrical portion 108 disposed symmetrically in a width direction W of the bobbin 101. Two coil terminals 109 of the coil are disposed on the same side bottom in the width direction W of the bobbin 101, and are substantially one-left and one-right coplanar in a length direction L of the bobbin 101. An integrally symmetrical round rod-shaped iron core 103 is fitted into a hole of the cylindrical portion 108 of the bobbin (i.e., the iron core hole of the bobbin 101), and an L-shaped yoke 102 integrally symmetrical in the width direction W of the bobbin 101 is fitted into the bobbin 101 and riveted with the iron core 103 to form a whole. The normally opened fixed contact terminal 105 and the normally closed fixed contact terminal 106, which are integrally L-shaped, are respectively fitted into the bobbin 101 in a lateral direction of the width direction W from the other side of the bobbin 101 opposite to the coil terminals 109, and are tightly engaged with the bobbin 101 through an extension end of the contact face. After being fitted and positioned, the normally opened fixed contact terminal 105 and the normally closed fixed contact terminal 106 extend out of the lead-out terminals at the lower part of a winding window of the bobbin 101, and are substantially one-left and one-right coplanar along the length direction L. Inside the winding window of the bobbin 101, in the width direction W, the normally opened fixed contact terminal 105 and the normally closed fixed contact terminal 106 are overlapped in a front-rear direction. Above the winding window of the bobbin 101, the bobbin 101 is provided with a raised mechanism 110 to limit the normally opened fixed contact terminal 105 and the normally closed fixed contact terminal 106, and the highest portion of the raised mechanism 110 for positioning is higher than a contact extension surface of the fixed contact terminal. After the movable spring armature assembly 104 and the outside of the yoke 102 are clamped and limited, an integral relay portion is formed. After the relay portion is sleeved with the housing 107, a relay is formed.

The aforesaid small-sized hinged electromagnetic relay has following disadvantages: (1) an insulation distance between an input end (the coil) and an output end (the fixed contact terminal and the yoke) is not enough and restrict insulation parameters of the product; (2) the fixed contact terminals are inserted from the side of the bobbin, and clamped and positioned to the bobbin through the contact extension surface, in such assembling mode, since mechanical parameters of the relay, such as a contact gap and a contact overstroke completely depend on processing precision of the bobbin, it is difficult to ensure and adjust a qualified rate of the mechanical parameters; (3) since plastic protruding blocks in many heights need to be arranged above the winding window of the bobbin, in the case that the relay has limited height, the height space of the winding window of the bobbin may be occupied, the winding space may be affected, the ampere turns value of the coil cannot be improved, and the relay performance may be restricted; (4) since the position where the fixed contact terminal clamps with the plastic is around the contact point, there is a failure that plastic chips are prone to fall into the contacts to cause non-conduction, and there is a hidden danger of lowering the insulation performance between the contacts due to the contact splashes may position plastic accumulation at the periphery; (5) the normally opened fixed contact terminal and the normally closed fixed contact terminal are overlapped back and forth in the width direction inside the winding window of the bobbin, the fixed contact terminal closer to the inside is distanced closer to an coil, thus reducing the insulation distance with the coil; and the structure of the two fixed contact terminals inside the winding window needs to be bent in the length direction L of the bobbin, which increases the difficulty and complexity of parts processing.

In order to solve the above problems, there are mainly two methods used in related art. One method is wrapping a whole circle of adhesive tape on the coil and the coil lead-out terminal, to increase insulation performance between the coil, the yoke and the fixed contact terminals, however, this method of wrapping the adhesive tape around the surface of the coil (enameled wire), on the one hand, has a risk of the coil breakage, and on the other hand, may increase cost due to addition of the materials and manufacturing process. The other method is installing insulation sheets between the coil and the yoke to improve the insulation performance between the coil and the yoke, however, this method of installing the insulation sheets between the coil and the yoke has shortcomings as follows: 1) it is difficult to assemble and thereby cannot ensure consistency of insulation effect; 2) the space for assembling the insulation sheets should be reserved, and thereby affecting the winding space of the coil and it is not good for improving the performance of the product; 3) it is difficult to solve the problem that the insulation distance between the coil terminal and the reed is not enough; 4), the cost will be increased due to addition of the materials and manufacturing processes. Moreover, neither of these two methods may solve the problem of foreign matters in contact positions and insulation degradation in use.

Figure 8:
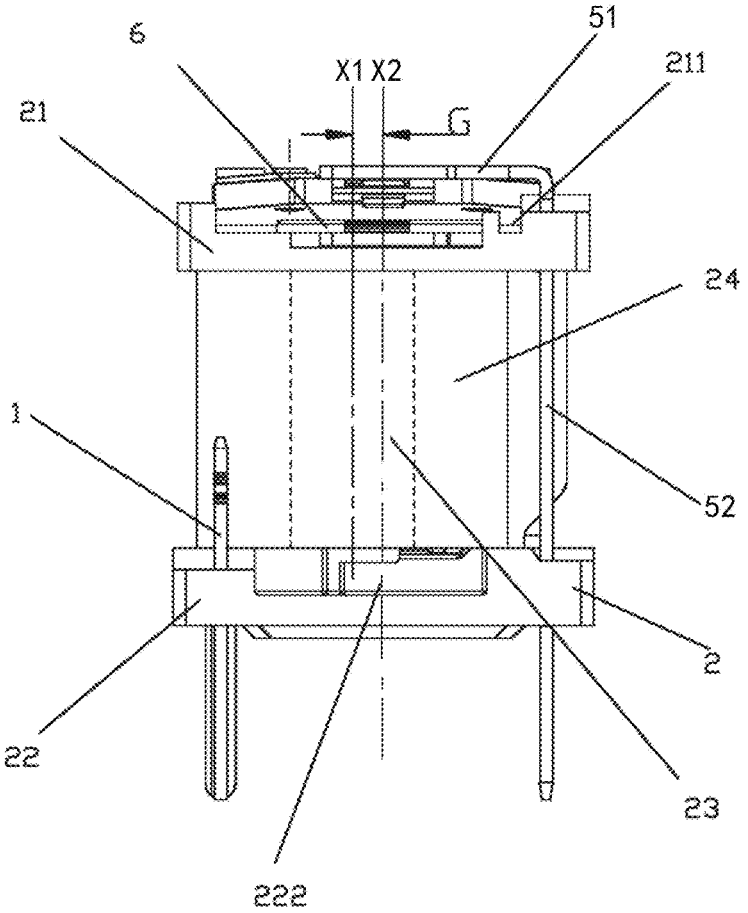
FIG. 8 is a side view of the embodiment of the present disclosure (removing the housing)
Figure 9:
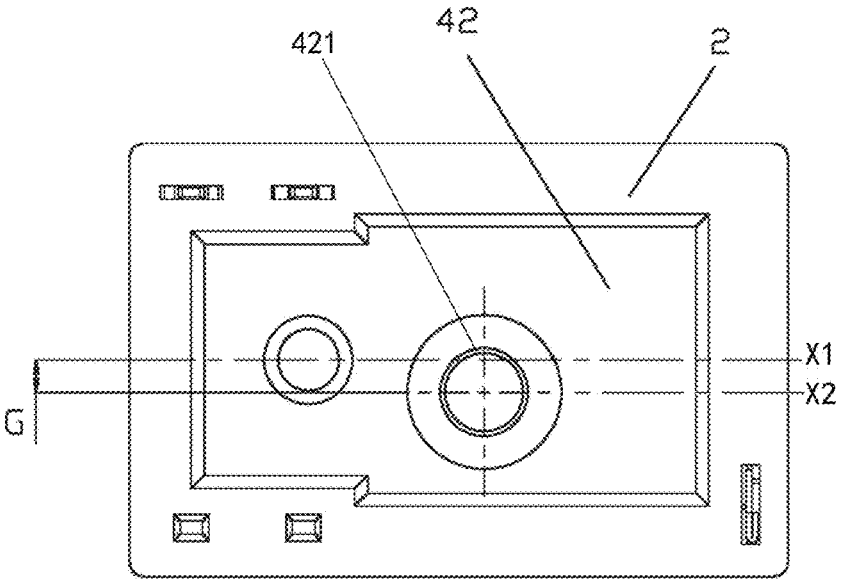
FIG. 9 is a bottom view of the embodiment of the present disclosure (removing the housing)
Figure 10:
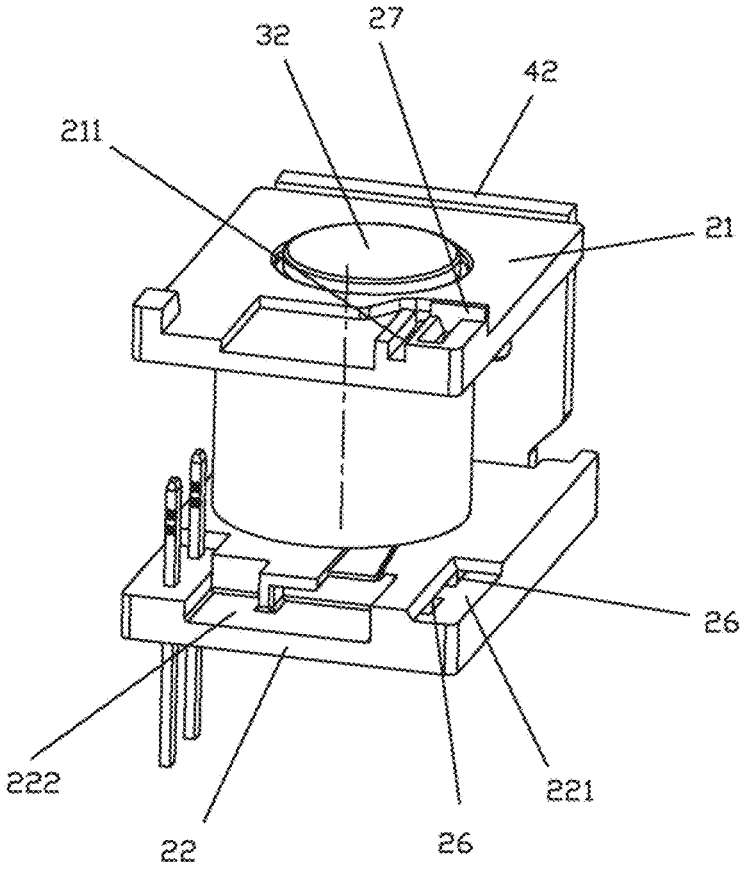
FIG. 10 is a schematic perspective view showing that a bobbin, an iron core and a yoke are cooperated with each other according to an embodiment of the present disclosure.
Figure 11:
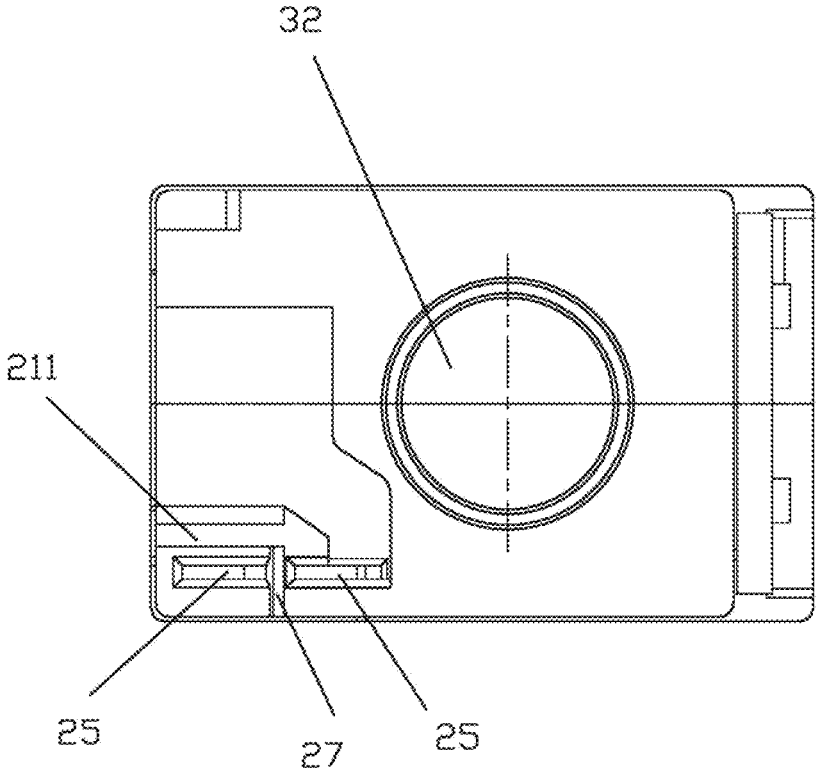
FIG. 11 is a top view showing that a bobbin, an iron core and a yoke are cooperated with each other according to an embodiment of the present disclosure.
Figure 12:
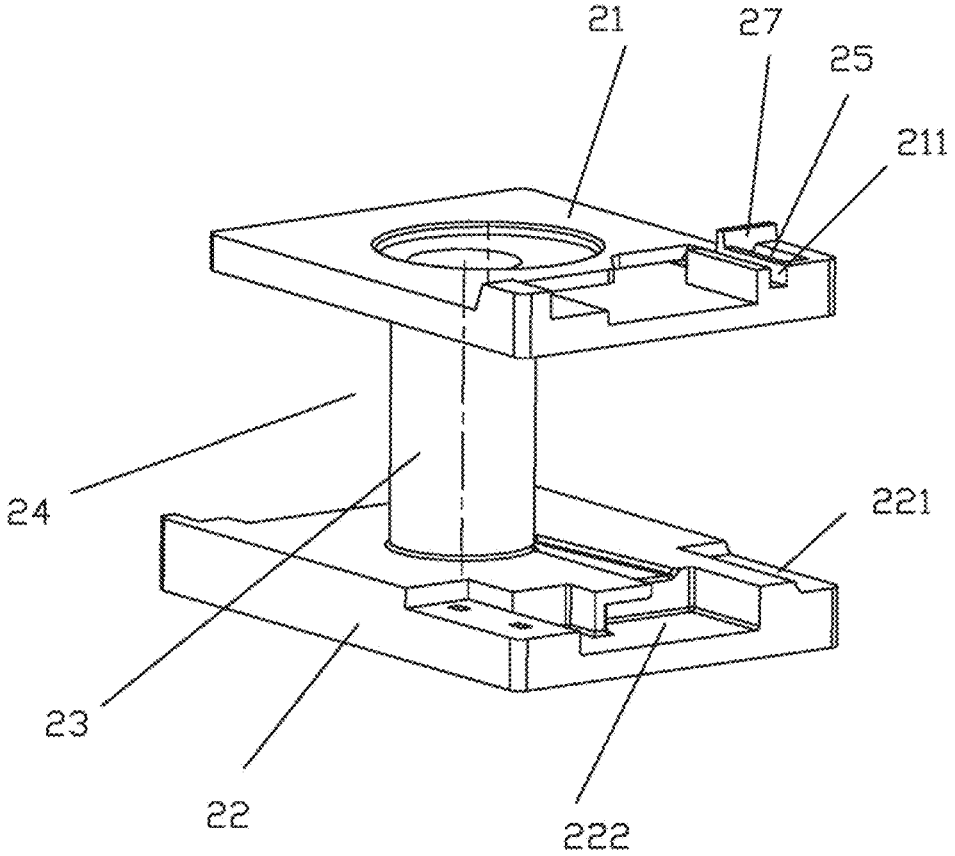
FIG. 12 is a schematic perspective view of a bobbin according to an embodiment of the present disclosure.
Figure 13:
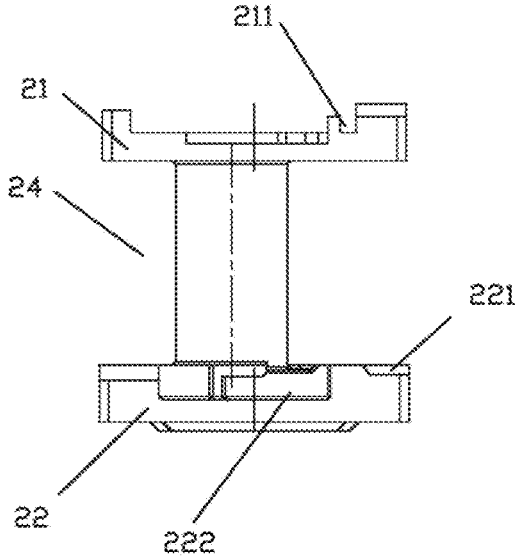
FIG. 13 is a side view of a bobbin according to an embodiment of the present disclosure.

Referring to FIGS. 5 to 22, a high-insulation small-sized hinged electromagnetic relay of the present disclosure includes a bobbin 2, coil terminals 1, an iron core 3 and a fixed contact block. The bobbin 2 includes an upper flange 21, a lower flange 22, and a cylindrical portion 23 connected between the upper flange and the lower flange and used for winding coil, wherein an axis of the cylindrical portion 23 is vertically arranged. The iron core 3 includes a mandrel 31 and a magnetic pole portion 32 arranged on the upper end of the mandrel. A mandrel 31 of the iron core 3 is fitted into a central hole of the cylindrical portion 23 of the bobbin 2. The magnetic pole portion 32 of the iron core 3 is located at the upper flange 21 of the bobbin 2 and in the middle position in the width direction of the bobbin 2. The coil terminals 1 are mounted on the lower flange 22 of the bobbin 2 and are located on one side in the width direction of the bobbin 2, and a part of the coil terminals 1 are located in a winding window 24 of the bobbin 2. The fixed contact block is interposed in the upper flange 21 and the lower flange 22 of the bobbin 2 and located on the other side in the width direction of the bobbin 2. The axis X1 of the cylindrical portion 23 deviates from the central line X2 of the width of the bobbin 2 by a preset distance G in a direction away from the fixed contact block (see FIG. 8), such that an axial symmetric center of the mandrel 31 of the iron core 3 is offset from an axial symmetric center of the magnetic pole portion 32 of the iron core 3 by the preset distance G, so as to increase a distance between the coil (i.e., after the cylindrical portion 23 winds the coil) and the fixed contact block, and increase a creepage distance between the coil and the fixed contact block; at the same time, it is also possible to shift in the length direction of the bobbin away from the yoke, to further increase the insulation between the coil and the yoke, to improve the insulation capability. This preset distance should be set according to the requirements of the insulation distance and the coil winding fullness, to ensure that the coil winding fullness does not exceed the periphery of the bobbin, but also ensure the insulation distance satisfies the specification requirements.

Figure 14:
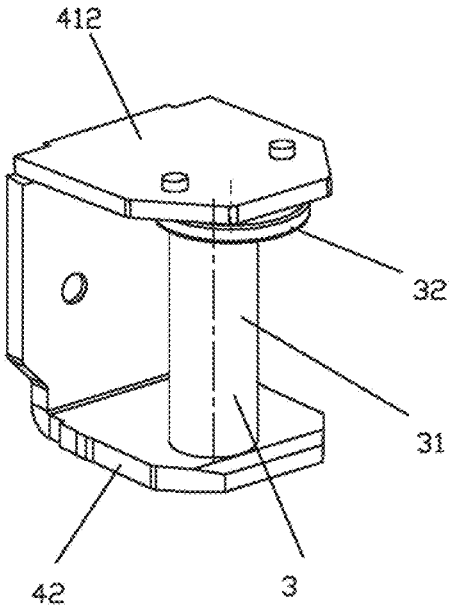
FIG. 14 is a schematic perspective view showing that an iron core, an armature and a yoke are cooperated with each other according to an embodiment of the present disclosure.
Figure 15:
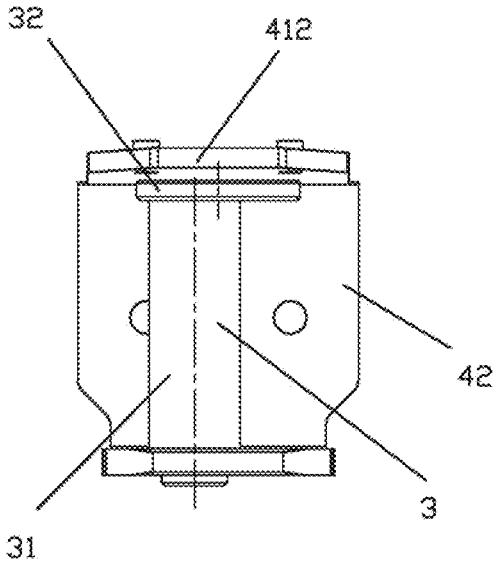
FIG. 15 is a side view showing that the iron core, the armature and the yoke are cooperated with each other according to an embodiment of the present disclosure.
Figure 16:
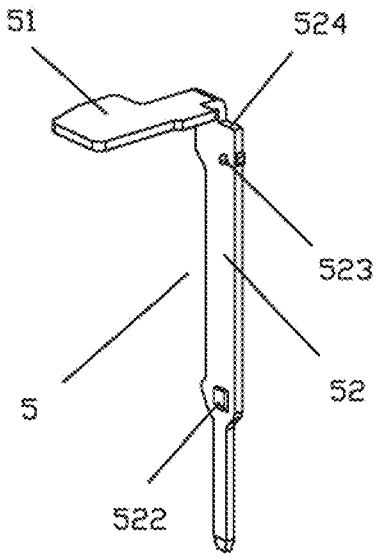
FIG. 16 is a schematic perspective view of an upper fixed contact terminal according to an embodiment of the present disclosure.
Figure 17:
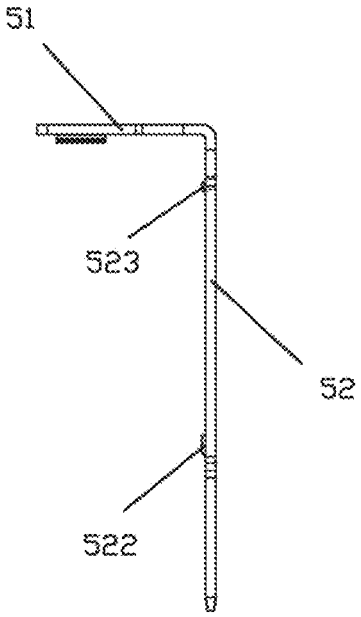
FIG. 17 is a front view of an upper fixed contact terminal according to an embodiment of the present disclosure.
Figure 18:
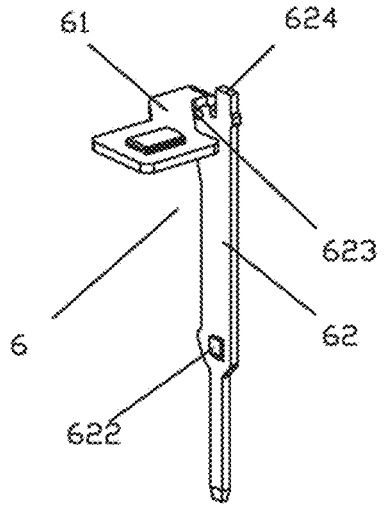
FIG. 18 is a schematic perspective view of a lower fixed contact terminal according to an embodiment of the present disclosure.
Figure 19:
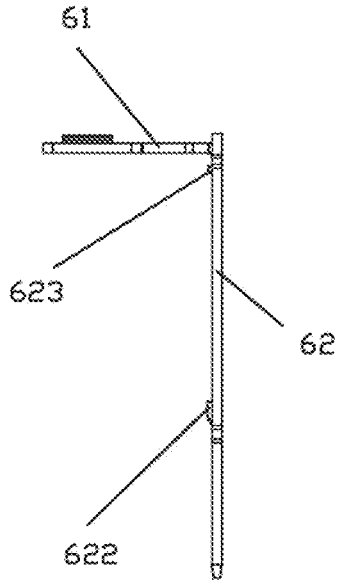
FIG. 19 is a front view of a lower fixed contact terminal according to an embodiment of the present disclosure.
Figure 20:
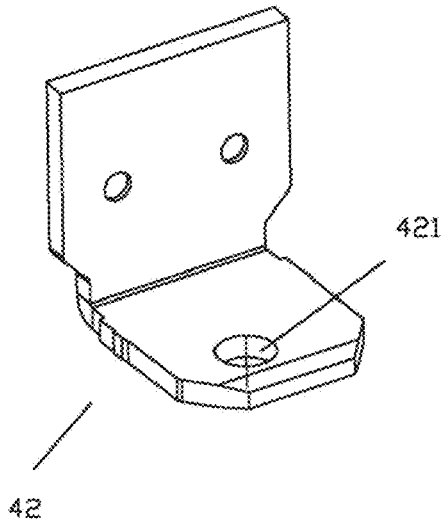
FIG. 20 is a schematic perspective view of a yoke according to an embodiment of the present disclosure.
Figure 21:
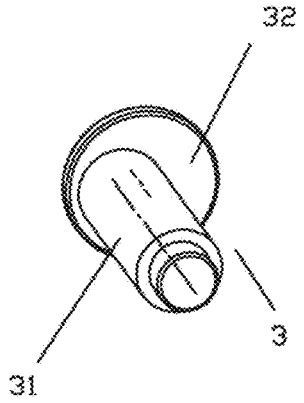
FIG. 21 is a schematic perspective view of an iron core according to an embodiment of the present disclosure.
Figure 22:
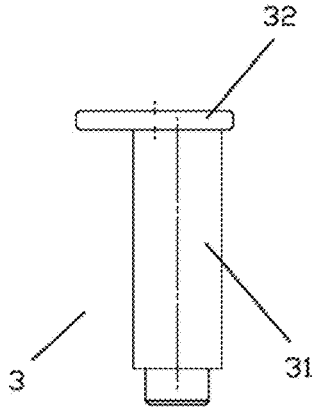
FIG. 22 is a side view of an iron core according to an embodiment of the present disclosure.

In one embodiment, the high insulation small-sized hinged electromagnetic relay of the present disclosure further includes a movable spring armature block 41 and a yoke 42, wherein the yoke 42 is L-shaped, the L-shaped yoke 42 has one side fixed to a bottom end of the mandrel 31 and the other side located at the winding window 24 of the bobbin 2 (see FIG. 14). The movable spring armature block 41 includes a movable contact piece 411 bent into an L-shape, and an armature 412 (see FIGS. 5 and 6). One side of the movable spring armature block (i.e., the L-shaped side of the movable contact piece 411) is fixed to the other side of the yoke 42, and the other side of the movable spring armature block (i.e., an integral part formed by fixing the L-shaped other side of the movable contact piece 411 to the armature 412) is located above the magnetic pole portion 32 of the iron core 3 at the upper flange 21 of the bobbin 2. A central line of the other side of the movable spring armature block 41 corresponding to the width direction of the bobbin is substantially collinear with a central line of the magnetic pole portion 32 of the iron core 3 corresponding to the width direction of the bobbin, to ensure stability of relay operation release.

In this embodiment, a first through hole 421 for positioning and assembling the bottom end of the mandrel 31 of the iron core 3 is provided on one side of the yoke 42. There is a preset distance G (see FIG. 9) between the central line X3 of one side of the yoke 42 corresponding to the central line X2 of the width direction of the bobbin and the central line (same as the axis X1 of the cylindrical portion 23) of the first through hole 421 on the other side of the yoke corresponding to the central line X2 of the width direction of the bobbin.

In this embodiment, the magnetic pole portion 32 of the iron core 3 is circular, oval or rectangular. Of course, the cross section of the iron core 3 may also be circular, oval or rectangular.

The fixed contact block includes an upper fixed contact terminal 5 (i.e., the normally closed fixed contact terminal) and a lower fixed contact terminal 6 (i.e., the normally opened fixed contact terminal), and the upper fixed contact terminal 5 and the lower fixed contact terminal 6 are L-shaped respectively. Each of the upper fixed contact terminal and the lower fixed contact terminal includes a horizontal sheet body and a vertical sheet body, that is, the upper fixed contact terminal 5 includes a horizontal sheet body 51 and a vertical sheet body 52, the horizontal sheet body 51 of the upper fixed contact terminal 5 is provided with fixed contact(s) arranged downwardly, the vertical sheet body 52 of the upper fixed contact terminal 5 is provided with a lead-out terminal on the bottom end thereof; the lower fixed contact terminal 6 includes a horizontal sheet body 61 and a vertical sheet body 62, the horizontal sheet body 61 of the lower fixed contact terminal 6 is provided with fixed contact(s) arranged upwardly, and the vertical sheet body 62 of the lower fixed contact terminal 6 is provided with a lead-out terminal on the bottom end thereof. The vertical sheet bodies 52 and 62 of the upper fixed contact terminal 5 and the lower fixed contact terminal 6 are respectively interposed in the other side of an upper flange 21 and a lower flange 22 of the bobbin corresponding to the width direction of the bobbin 2 and opposite to the coil terminals, so that the horizontal sheet body 51 of the upper fixed contact terminal 5 and the horizontal sheet body 61 of the lower fixed contact terminal 6 are matched with the portion of the movable contact piece provided with the movable contact(s) in the movable spring armature block 41, and the portion of the movable contact piece provided with the movable contact(s) is located between the horizontal sheet body 51 of the upper fixed contact terminal 5 and the horizontal sheet body 61 of the lower fixed contact terminal 6; and portions 521, 621 of the vertical sheet bodies 52, 62 of the upper fixed contact terminal 5 and the lower fixed contact terminal 6 located in the winding window 24 of the bobbin 2 are vertical structures and are arranged in parallel along the length direction of the bobbin 2.

In this embodiment, a thickness direction of the vertical sheet bodies 52 and 62 of the upper fixed contact terminal 5 and the lower fixed contact terminal 6 is consistent with the width direction of the bobbin 2. The portions 521, 621 of the vertical sheet bodies 52, 62 of the upper fixed contact terminal 5 and the lower fixed contact terminal 6 located in the winding window 24 of the bobbin 2 are arranged coplanar on the other side of the width direction of the bobbin, that is, the portion 521 of the vertical sheet body 52 of the upper fixed contact terminal 5 and the portion 621 of the vertical sheet body 62 of the lower fixed contact terminal 6 are in coplanar.

In this embodiment, the upper flange 21 and the lower flange 22 of the bobbin 2 are respectively provided with second through holes 25 (see FIG. 11) and third through holes 26 (see FIG. 10), which are annularly closed and inserted to cooperate with the vertical sheet body 52 of the upper fixed contact terminal 5 and the vertical sheet body 62 of the lower fixed contact terminal 6, so that the upper fixed contact terminal 5 and the lower fixed contact terminal 6 may only be assembled into the bobbin 2 from up to down. The second through holes 25 are two, respectively matched with the upper fixed contact terminal 5 and the lower fixed contact terminal 6, and the third through holes 26 are also two, respectively matched with the upper fixed contact terminal 5 and the lower fixed contact terminal 6

In this embodiment, since the cross sections of the vertical sheet body 52 of the upper fixed contact terminal 5 and the vertical sheet body 62 of the lower fixed contact terminal 6 are rectangular, the shapes of the second through hole 25 and the third through hole 26 are also rectangular. The lengths of the second through hole 25 and the third through hole 26 are respectively adapted to the widths of the vertical sheet body 52 of the upper fixed contact terminal 5 and the vertical sheet body 62 of the lower fixed contact terminal 6; the widths of the second through hole 25 and the third through hole 26 are adapted to the thicknesses of the vertical sheet body 52 of the upper fixed contact terminal 5 and the vertical sheet body 62 of the lower fixed contact terminal 6; and the width of the second through hole 25 is larger than the width of the third through hole 26. Clamping protrusions 522, 622 fixed with the corresponding third through hole 26 are provided on one surface in the thickness direction of the lower portions of the vertical sheet body 52 of the upper fixed contact terminal 5 and the vertical sheet body 62 of the lower fixed contact terminal 6. The upper fixed contact terminal 5 and the lower fixed contact terminal 6 are fixed on the bobbin 2 by matching the clamping protrusions 522 and 622 at the lower portions of the vertical sheet bodies 52 and 62 with the corresponding third through holes 26 of the lower flange 22 of the bobbin 2, and the horizontal sheet body 51 of the upper fixed contact terminal 5 and the horizontal sheet body 61 of the lower fixed contact terminal 6 are completely exposed on the upper flange 21 of the bobbin 2, that is, there is no plastic around the position of the fixed contact terminal contact face, and the bobbin plastic is lower than the fixed contact terminal contact face. In this embodiment, the width of the second through hole 25 is also designed to be larger than the thicknesses of the vertical sheet body 52 of the upper fixed contact terminal 5 and the vertical sheet body 62 of the lower fixed contact terminal 6, so that it may be avoided that the plastic chips may be produced on the upper portion when the upper fixed contact terminal 5 and the lower fixed contact terminal 6 are inserted.

In this embodiment, positioning protrusions 523, 623 matched with the corresponding second through holes 25 are provided on one surface in the thickness direction of the upper portions of the vertical sheet body 52 of the upper fixed contact terminal 5 and the vertical sheet body 62 of the lower fixed contact terminal 6. The upper fixed contact terminal 5 and the lower fixed contact terminal 6 are adjusted in positions on the bobbin 2 by matching the positioning protrusions 523, 623 of the upper portions of the vertical sheet bodies 52, 62 with the corresponding second through holes 25 of the upper flange 21 of the bobbin 2.

In this embodiment, cut-off cross sections 524 and 624 of the fixed contact terminal materials are further provided beside the position integrally connected with the horizontal sheet bodies 51 and 61 in the top ends of the vertical sheet body 52 of the upper fixed contact terminal 5 and the vertical sheet body 62 of the lower fixed contact terminal 6, to provide press-in positions for preset corresponding tools, and press the upper fixed contact terminal 5 and the lower fixed contact terminal 6 into the bobbin 2, and the press-in positions are substantially collinear with the clamping protrusions 522 and 622 of the vertical sheet bodies in the height direction corresponding to the bobbin; and positioning protrusions 523, 623 are also substantially collinear, that is, in the upper fixed contact terminal 5, the cut-off cross section 524, the positioning protrusion 523 and the clamping protrusion 522 are substantially collinear, and in the lower fixed contact terminal 6, the cut-off cross section 624, the positioning protrusion 623 and the clamping protrusion 622 are also substantially collinear.

In this embodiment, a sinking plane 221 lower than the winding window is further provided at the insertion position corresponding to the upper fixed contact terminal 5 and the lower fixed contact terminal 6 on one surface corresponding to the winding window 24 of the bobbin 2, in the lower flange 22 of the bobbin 2, to further increase the creepage distance between the position and the coil; an inclined chamfer is provided between the sinking plane 221 and the winding window 24, and an edge of the chamfer is flush with the third through hole 26. By setting the chamfer, production of the plastic chips may be reduced.

In this embodiment, a first groove 211 is provided near the vertical sheet body 52 of the upper fixed contact terminal 5 between the horizontal sheet body 61 of the lower fixed contact terminal 6 and the vertical sheet body 52 of the upper fixed contact terminal 5, in the upper flange 21 of the bobbin 2. The first groove 211 is provided along the length direction of the bobbin 2, and a length dimension of the first groove 211 is larger than a width dimension of the vertical sheet body 52 of the upper fixed contact terminal 5. Possibility of the contact splash accumulating on the upper fixed contact terminal and the lower fixed contact terminal may further reduced by using the first groove 211.

In this embodiment, in the upper flange 21 of the bobbin 2, a retaining wall 27 is further provided between the two second through holes 25 above the upper flange 21, to increase the insulation distance between the upper fixed contact terminal 5 and the lower fixed contact terminal 6.

In this embodiment, in the lower flange 22 of the bobbin 2, a second groove 222 is also provided between the coil terminals 1 and the insertion positions of the upper fixed contact terminal 5 and the lower fixed contact terminal 6, in the one surface corresponding to the winding window 24 of the bobbin 2. The creepage distance may be increased by using the second groove 222, and uniform shrinkage may be ensured and the shrinkage deformation may be avoided.

According to the high-insulation small-sized hinged electromagnetic relay of the present disclosure, the magnetic pole portion 32 of the iron core 3 is arranged on the upper flange 21 of the bobbin 2 and is located in the middle position in the width direction of the bobbin 2; the coil terminals 1 are assembled on the lower flange 22 of the bobbin 2 and located on one side in width direction of the bobbin 2; and the fixed contact block is interposed in the upper flange 21 and the lower flange 22 of the bobbin 2 and located on the other side in the width direction of the bobbin 2. And the axis of the cylindrical portion 23 is designed to deviate from the central line of the width of the bobbin 2 to a direction away from the fixed contact block by a preset distance, so that the axial symmetric center of the mandrel 31 of the iron core 3 is offset from the axial symmetric center of the magnetic pole portion 32 of the iron core by the preset distance. According to the structure of the present disclosure, by retaining the magnetic pole portion 32 of the iron core 3 at the axis symmetric center of the product, the cylindrical portion of the bobbin and the mandrel 31 of the iron core 3 are eccentrically arranged, so that the coil (i.e., after winding the coil on the cylindrical portion) is integrally eccentric and leans towards the side far away from the fixed contact block. This may increase the distance between the coil and the fixed contact terminal without affecting the magnetic circuit balance, and thereby may increase the creepage distance between the coil and the fixed contact terminal, and improve the insulation capability.

According to the high-insulation small-sized hinged electromagnetic relay, the cylindrical portion 23 of the bobbin 2 is eccentrically arranged, in the case of keeping the ampere turns of or the coil unchanged, to increase the distance between the coil and the fixed contact terminal, increase the creepage distance, and improve the dielectric strength. Meanwhile, the cylindrical portion 23 of the bobbin 2 may also shift to the direction away from the yoke in the length direction of the bobbin, to further increase the insulation between the coil and the yoke; and when the distance between the coil and the fixed contact terminal is sufficient and does not need to be increased, the coil turns may be increased, the ampere turns value may be improved, the contact suction may be enhanced, and thereby further increase the contact pressure, reduce rebound, ensure the contact stability, reduce the arc, and improve the service life and reliability of the contacts.

According to the high-insulation small-sized hinged electromagnetic relay of the present disclosure, the cylindrical portion 23 of the bobbin 2 is eccentrically arranged and leans to one side far away from the fixed contact block, to leave space for assembling of the fixed contact terminal on the bobbin 2. According to the present disclosure, the portion 521 of the vertical sheet body 52 of the upper fixed contact terminal 5 and the portion 621 of the vertical sheet body 62 of the lower fixed contact terminal 6 located in the winding window of the bobbin are vertical structures and are arranged in parallel along the length direction of the bobbin 2, and the portion 521 of the vertical sheet body of the upper fixed contact terminal 5 and the portion 621 of the vertical sheet body of the lower fixed contact terminal 6 located in the winding window of the bobbin are arranged coplanar on the other side of the width of the bobbin. According to the structure of the present disclosure, the insulation distance between the fixed contact block and the coil may be ensured while the manufacturing difficulty of the fixed contact block may be reduced; the portions 521 and 621 of the upper fixed contact terminal and the lower fixed contact terminal located in the winding window of the bobbin are vertical structures, to avoid the disadvantages caused by bending the fixed contact terminal in the related art, and reduce the manufacturing process, and simultaneously reduce the size of the relay and thereby realizing miniaturization.

According to the high-insulation small-sized hinged electromagnetic relay of the present disclosure, the upper flange 21 and the lower flange 22 of the bobbin are respectively provided with a second through hole 25 and a third through hole 26, which are annularly closed and through which the vertical sheet body 52 and the vertical sheet body 62 respectively matched with the upper fixed contact terminal 5 and the lower fixed contact terminal 6 are inserted, so that the upper fixed contact terminal 5 and the lower fixed contact terminal 6 are interposed into the bobbin 2 from up to down. Since the press-in direction of the fixed contact terminal is from up to down, this direction is a direction that affects the contact gap and the overstroke of the relay. By automatically adjusting the position of the fixed contact terminal as being pressed in, the mechanical parameters of the relay may be adjusted in real time, the qualification rate of the parameters may be effectively improved, and the dependence on the precision of the parts of the bobbin may be reduced; and meanwhile, such assembling mode from up to down may also facilitate for realization of automatic assembling.

According to the high-insulation small-sized hinged electromagnetic relay of the present disclosure, one surface in the thickness direction of the lower portions of the vertical sheet body 52 of the upper fixed contact terminal 5 and the vertical sheet body of the lower fixed contact terminal 6 is provided with clamping protrusions 522 and 622 fixed with corresponding third through holes. The upper fixed contact terminal 5 and the lower fixed contact terminal 6 are fixed on the bobbin by matching the clamping protrusions 522 and 622 of the lower portions of the vertical sheet bodies with the corresponding third through holes 26 of the lower flange 22 of the bobbin. As the clamping position of the fixed contact terminal and the bobbin is position at the bottom of the bobbin and facing away from the contact mechanism, and being isolated by a large plastic surface in the middle such that plastic foreign substances in the clamping position cannot be easily transferred to the contact position. In addition, since the position of the fixed contact terminal close to the contact face is not required to be positioned as the related art, the plastic of the bobbin at the position may be removed, so that no redundant plastic is left around the contact, the splash generated in the process of using the contact may be arranged away from the contact, and an influence due to disconnecting the insulation between the contacts may be reduced. After removing the plastic from the bobbin at this position, the design of plastic height at this position may be reduced, so that the saved space may be left for the winding space of the bobbin under the condition that the overall height of the relay is unchanged; and the coil may obtain more ampere turns without affecting the insulation distance, and it is beneficial to improve the comprehensive performance of the relay.

According to the high-insulation small-sized hinged electromagnetic relay of the present disclosure, the cut-off cross sections 524 and 624 of the fixed contact terminal materials are provided beside positions integrally connected with the horizontal sheet bodies 51 and 61, in the top ends of the vertical sheet body 52 of the upper fixed contact terminal 5 and the vertical sheet body 62 of the lower fixed contact terminal 6, to provide press-in positions for preset corresponding tools. The upper fixed contact terminal 5 and the lower fixed contact terminal 6 are pressed into the bobbin, and the press-in positions are approximately collinear with the clamping protrusions 522 and 622 of the vertical sheet bodies in the height direction corresponding to the bobbin. According to the structure of the present disclosure, deflection torque cannot be generated when the fixed contact terminal is pressed into the bobbin, and the accuracy of the pressed-in position may be improved.

Compared with the related art, the present disclosure has advantageous effects as follows:

1. It is adopted in the present disclosure that the magnetic pole portion of the iron core is arranged on the upper flange of the bobbin and is located in the middle position in the width direction of the bobbin; the coil terminals 1 are assembled on the lower flange of the bobbin and located on one side in width direction of the bobbin; and the fixed contact block is interposed in the upper flange and the lower flange of the bobbin and located on the other side in the width direction of the bobbin. And the axis of the cylindrical portion is designed to deviate from the central line of the width of the bobbin to a direction away from the fixed contact block by a preset distance, so that the axial symmetric center of the mandrel of the iron core is offset from the axial symmetric center of the magnetic pole portion of the iron core by the preset distance. According to the structure of the present disclosure, by retaining the magnetic pole portion of the iron core at the axis symmetric center of the product, the cylindrical portion of the bobbin and the mandrel of the iron core are eccentrically arranged, so that the coil (i.e., after winding the coil on the cylindrical portion) is integrally eccentric and leans towards the side far away from the fixed contact block. This may increase the distance between the coil and the fixed contact terminal without affecting the magnetic circuit balance, and thereby may increase the creepage distance between the coil and the fixed contact terminal, and improve the insulation capability.

2. It is adopted in the present disclosure that the cylindrical portion of the bobbin is eccentrically arranged, in the case of keeping the ampere turns of the coil unchanged, to increase the distance between the coil and the fixed contact terminal, increase the creepage distance, and improve the dielectric strength. Meanwhile, the cylindrical portion of the bobbin may also shift to the direction away from the yoke in the length direction of the bobbin, to further increase the insulation between the coil and the yoke; and when the distance between the coil and the fixed contact terminal is sufficient and does not need to be increased, the coil turns may be increased, the ampere turns value may be improved, the contact suction may be enhanced, and thereby further increase the contact pressure, reduce rebound, ensure the contact stability, reduce the arc, and improve the service life and reliability of the contacts.

3. It is adopted in the present disclosure that the cylindrical portion of the bobbin is eccentrically arranged and leans to one side far away from the fixed contact block, to leave space for assembling of the fixed contact terminal on the bobbin. According to the present disclosure, the portions of the vertical sheet bodies of the upper fixed contact terminal and the lower fixed contact terminal located in the winding window of the bobbin are vertical structures and are arranged in parallel along the length direction of the bobbin, and the portions of the vertical sheet bodies of the upper fixed contact terminal and the lower fixed contact terminal located in the winding window of the bobbin are arranged coplanar on the other side of the width of the bobbin. According to the structure of the present disclosure, the insulation distance between the fixed contact block and the coil may be ensured while the manufacturing difficulty of the fixed contact block may be reduced; the portions of the upper fixed contact terminal and the lower fixed contact terminal located in the winding window of the bobbin are vertical structures, to avoid the disadvantages caused by bending the fixed contact terminal in the related art, and reduce the manufacturing process, and simultaneously reduce the size of the relay and thereby realizing miniaturization.

4. It is adopted in the present disclosure that the upper flange and the lower flange of the bobbin are respectively provided with a second through hole and a third through hole, which are annularly closed and through which the vertical sheet body and the vertical sheet body respectively matched with the upper fixed contact terminal and the lower fixed contact terminal are inserted, so that the upper fixed contact terminal and the lower fixed contact terminal are interposed into the bobbin from up to down. Since the press-in direction of the fixed contact terminal is from up to down, this direction is a direction that affects the contact gap and the overstroke of the relay. By automatically adjusting the position of the fixed contact terminal as being pressed in, the mechanical parameters of the relay may be adjusted in real time, the qualification rate of the parameters may be effectively improved, and the dependence on the precision of the parts of the bobbin may be reduced; and meanwhile, such assembling mode from up to down may also facilitate for realization of automatic assembling.

5. It is adopted in the present disclosure that one surface in the thickness direction of the lower portions of the vertical sheet body of the upper fixed contact terminal and the vertical sheet body of the lower fixed contact terminal is provided with clamping protrusions fixed with corresponding third through holes. The upper fixed contact terminal and the lower fixed contact terminal are fixed on the bobbin by matching the clamping protrusions of the lower portions of the vertical sheet bodies with the corresponding third through holes of the lower flange of the bobbin. As the clamping position of the fixed contact terminal and the bobbin is position at the bottom of the bobbin and facing away from the contact mechanism, and being isolated by a large plastic surface in the middle such that plastic foreign substances in the clamping position cannot be easily transferred to the contact position. In addition, since the position of the fixed contact terminal close to the contact face is not required to be positioned as the related art, the plastic of the bobbin at the position may be removed, so that no redundant plastic is left around the contact, the splash generated in the process of using the contact may be arranged away from the contact, and an influence due to disconnecting the insulation between the contacts may be reduced. After removing the plastic from the bobbin at this position, the design of plastic height at this position may be reduced, so that the saved space may be left for the winding space of the bobbin under the condition that the overall height of the relay is unchanged; and the coil may obtain more ampere turns without affecting the insulation distance, and it is beneficial to improve the comprehensive performance of the relay.

6. It is adopted in the present disclosure that the cut-off cross sections of the fixed contact terminal materials are provided beside positions integrally connected with the horizontal sheet bodies, in the top ends of the vertical sheet bodies of the upper fixed contact terminal and the lower fixed contact terminal, to provide press-in positions for preset corresponding tools. The upper fixed contact terminal and the lower fixed contact terminal are pressed into the bobbin, and the press-in positions are approximately collinear with the clamping protrusions of the vertical sheet bodies in the height direction corresponding to the bobbin. According to the structure of the present disclosure, deflection torque cannot be generated when the fixed contact terminal is pressed into the bobbin, and the accuracy of the pressed-in position may be improved.

The foregoing description is only a preferred embodiment of the present disclosure and is not intended to limit the present disclosure in any form. Although the preferred embodiment has been disclosed in the present disclosure as above mentioned, it is not used to limit the present disclosure. Any person skilled in the art may make many possible changes and modifications to the technical solution of the present disclosure by using the above disclosed technical contents, or modify the technical solution into equivalent embodiments, without departing from the scope of the technical solution of the present disclosure. Thus, any simple modifications, equivalent changes and modifications made to the above embodiments according to the technical solution of the present disclosure without departing from the contents of the technical solution of the present disclosure shall fall within the protection scope of the technical solution of the present disclosure.

The invention claimed is:

1. A high-insulation small-sized hinged electromagnetic relay, comprising:

a bobbin having an upper flange, a lower flange, and a cylindrical portion connected between the upper flange and the lower flange and used for winding a coil, and an axis of the cylindrical portion being vertically arranged;

an iron core comprising a mandrel and a magnetic pole portion arranged on an upper end of the mandrel; the mandrel of the iron core being fitted into a central hole of the cylindrical portion of the bobbin, the magnetic pole portion of the iron core being positioned on the upper flange of the bobbin and positioned in a middle position in a width direction of the bobbin;

coil terminals being assembled on the lower flange of the bobbin and positioned on one side in the width direction of the bobbin, and a part of the coil terminals being positioned in a winding window of the bobbin; and a fixed contact block being interposed in the upper flange and the lower flange of the bobbin and positioned on the other side of the bobbin in the width direction, wherein an axis of the cylindrical portion deviates to a direction away from the fixed contact block with respect to the central line of the width of the bobbin by a preset distance, so that an axial symmetric center of the mandrel of the iron core is offset from the axial symmetric center of the magnetic pole portion of the iron core by the preset distance, to increase a distance between the coil and the fixed contact block, increase a creepage distance between the coil and the fixed contact block, and improve insulation capability, wherein the fixed contact block comprises an upper fixed contact terminal and a lower fixed contact terminal, and the upper fixed contact terminal and the lower fixed contact terminal are L-shaped; vertical sheet bodies of the upper fixed contact terminal and the lower fixed contact terminal are respectively interposed in the upper flange and the lower flange of the bobbin, and are positioned on other side of the coil terminals in the width direction of the bobbin; portions of the vertical sheet bodies of the upper fixed contact terminal and the lower fixed contact terminal positioned in the winding window of the bobbin are vertical structures and are arranged in parallel along a length direction of the bobbin.

2. The high-insulation small-sized hinged electromagnetic relay according to claim 1, further comprising:

a yoke having one side fixed to a bottom end of the mandrel, and the other side positioned at the winding window of the bobbin; and a movable spring armature block having one side fixed to the other side of the yoke, and the other side positioned above the magnetic pole portion of the iron core at the upper flange of the bobbin; a central line of the other side of the movable spring armature block corresponding to the width direction of the bobbin is substantially collinear with a central line of the magnetic pole portion of the iron core corresponding to the width direction of the bobbin.

3. The high-insulation small-sized hinged electromagnetic relay according to claim 2, wherein a first through hole for positioning and assembling a bottom end of the mandrel of the iron core is provided on one side of the yoke, and there is a preset distance between a central line on one side of the yoke corresponding to the width of the bobbin and a central line of the first through hole on one side of the yoke corresponding to the width direction of the bobbin.

4. The high insulation small-sized hinged electromagnetic relay according to claim 1, wherein the magnetic pole portion of the iron core is circular, oval or rectangular.

5. The high-insulation small-sized hinged electromagnetic relay according to claim 1, wherein a thickness direction of the vertical sheet bodies of the upper fixed contact terminal and the lower fixed contact terminal is consistent with a width direction of the bobbin; portions of the vertical sheet bodies of the upper fixed contact terminal and the lower fixed contact terminal positioned in the winding window of the bobbin are coplanar on the other side of the width of the bobbin.

6. The high-insulation small-sized hinged electromagnetic relay according to claim 1, wherein the upper flange and the lower flange of the bobbin are respectively provided with second through holes and third through holes, which are annularly closed and through which the vertical sheet bodies of the upper fixed contact terminal and the lower fixed contact terminal are inserted, so that the upper fixed contact terminal and the lower fixed contact terminal may only be assembled into the bobbin from up to down.

7. The high-insulation small-sized hinged electromagnetic relay according to claim 6, wherein a width of the second through hole is larger than a width of the third through hole, one surface in the thickness direction of the lower portions of the vertical sheet bodies of the upper fixed contact terminal and the lower fixed contact terminal is provided with a clamping protrusion fixed with the corresponding third through hole; the upper fixed contact terminal and the lower fixed contact terminal are fixed on the bobbin by matching the clamping protrusion of the lower portion of the vertical sheet body with the corresponding third through hole of the lower flange of the bobbin, and horizontal sheet bodies of the upper fixed contact terminal and the lower fixed contact terminal are completely exposed on the upper flange of the bobbin; one surface in the thickness direction of the upper portions of the vertical sheet bodies of the upper fixed contact terminal and the lower fixed contact terminal is provided with a positioning protrusion matched with the corresponding second through hole, and the upper fixed contact terminal and the lower fixed contact terminal are adjusted in positions on the bobbin by matching the positioning protrusion of the upper portion of the vertical sheet body with the corresponding second through hole of the upper flange of the bobbin.

8. The high-insulation small-sized hinged electromagnetic relay according to claim 1, wherein a cut-off cross section of fixed contact terminal materials is further provided beside a position integrally connected with the horizontal sheet body, in top ends of the vertical sheet bodies of the upper fixed contact terminal and the lower fixed contact terminal, to provide a press-in position for a preset corresponding tool, the upper fixed contact terminal or the lower fixed contact terminal is pressed into the bobbin, and the press-in position and the clamping protrusion of the vertical sheet body are approximately collinear in a height direction corresponding to the bobbin.

9. The high-insulation small-sized hinged electromagnetic relay according to claim 6, wherein a sinking platform lower than the winding window is further provided at an insertion position of the upper fixed contact terminal and the lower fixed contact terminal corresponding to one side of the winding window of the bobbin, in the lower flange of the bobbin, to further increase a creepage distance between the position and the coil; an inclined chamfer is arranged between the sinking platform and the winding window, and an edge of the chamfer is flush with the third through hole; a first groove is arranged near the vertical sheet body of the upper fixed contact terminal, between the horizontal sheet body of the lower fixed contact terminal and the vertical sheet body of the upper fixed contact terminal, in the upper flange of the bobbin; the first groove is arranged along the length direction of the bobbin, and a length dimension of the first groove is larger than a width dimension of the vertical sheet body of the upper fixed contact terminal; a second groove is also arranged between the coil terminals and the insertion positions of the upper fixed contact terminal and the lower fixed contact terminal, in one surface corresponding to the winding window of the bobbin, in the lower flange of the bobbin.

10. The high-insulation small-sized hinged electromagnetic relay as claimed in claim 6, wherein a retaining wall is further arranged between the two second through holes on the upper flange in the upper flange, in the upper flange of the bobbin, to increase an insulation distance between the upper fixed contact terminal and the lower fixed contact terminal.

* * * * *